United States Patent [19]

Hall

[11] 4,034,765

[45] July 12, 1977

[54] TOBACCO SMOKE FILTER

[75] Inventor: Floyd Van Hall, Durham, N.C.

[73] Assignee: Liggett & Myers Incorporated, Durham, N.C.

[21] Appl. No.: 627,168

[22] Filed: Oct. 30, 1975

[51] Int. Cl.[2] ..... A24D 1/04; A24F 5/04

[52] U.S. Cl. ..... 131/10 A; 131/10.5

[58] Field of Search ..... 131/10 A, 10 R, 10.5, 131/10.7, 10.3, 10.9, 15 B, 261 B, 201, 202, 264–269, 261 R, 198 A, 198 R

[56] References Cited

U.S. PATENT DOCUMENTS

| | | | |
|---|---|---|---|
| 3,313,306 | 4/1967 | Berger et al. | 131/10.7 |
| 3,348,553 | 10/1967 | Huber | 131/207 X |
| 3,396,061 | 8/1968 | Browne | 131/10.9 X |
| 3,405,717 | 10/1968 | Berger et al. | 131/94 |
| 3,596,663 | 8/1971 | Schultz et al. | 131/10 A |
| 3,630,210 | 12/1971 | Haslam | 131/261 B |
| 3,791,265 | 2/1974 | Westcott et al. | 93/1 C |
| 3,860,011 | 1/1975 | Norman | 131/10 A X |
| 3,888,160 | 6/1975 | Westcott et al. | 93/1 C |

FOREIGN PATENT DOCUMENTS

| | | | |
|---|---|---|---|
| 289,553 | 3/1965 | Netherlands | 131/266 |

*Primary Examiner*—John F. Pitrelli

*Attorney, Agent, or Firm*—Michael L. Hendershot; J. Bowen Ross, Jr.

[57] ABSTRACT

This invention relates to a cigarette filter composed of two concentric cylindrical layers of fibrous filter materials, in which the inner cylindrical layer has a lower draw resistance than the outer cylindrical layer.

4 Claims, 9 Drawing Figures

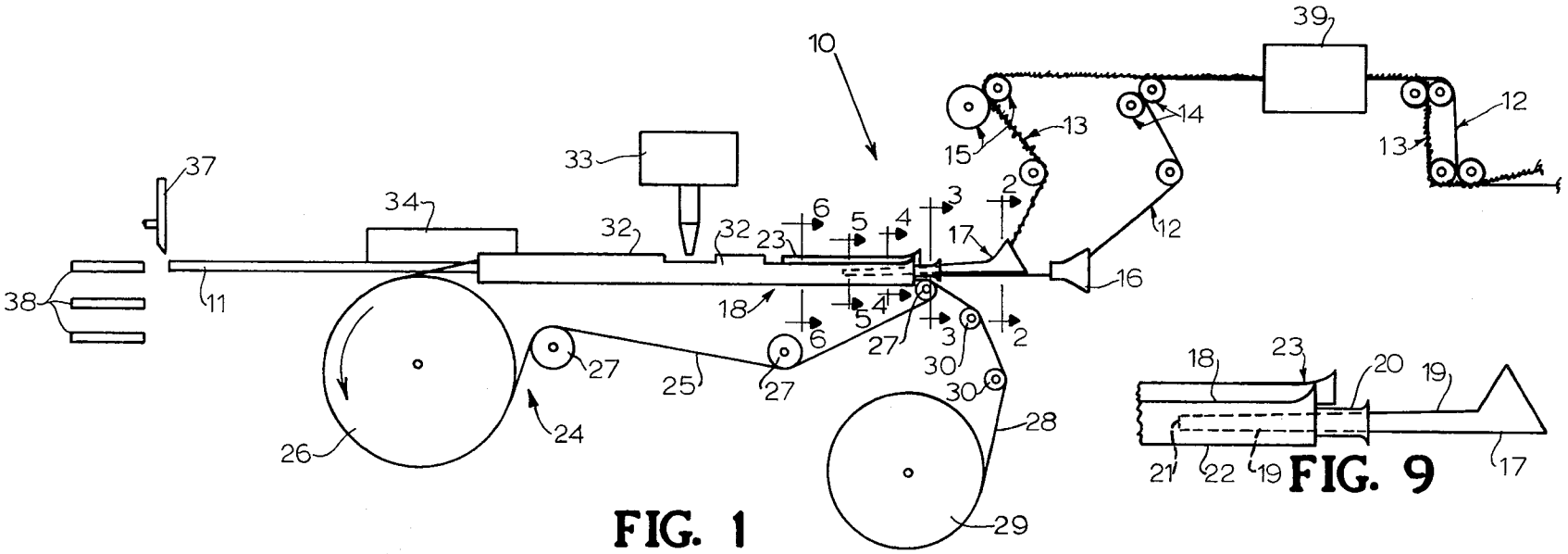
FIG. 1
FIG. 9
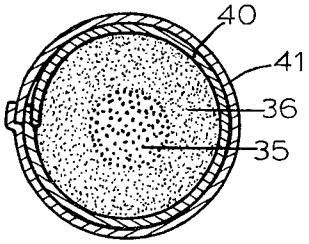
FIG. 8
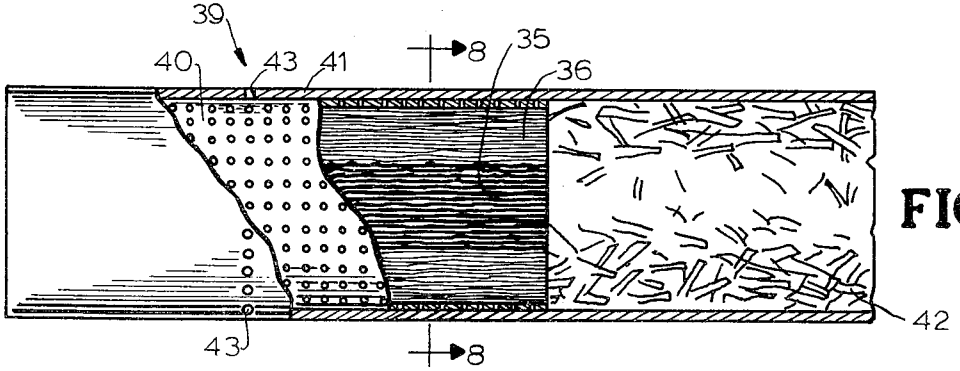
FIG. 7

TOBACCO SMOKE FILTER

This invention relates to a filter rod suitable for use in making filters for cigarettes. In particular, the present invention involves a cigarette filter composed of two concentric cylinders of fibrous filter materials possessing different filtering characteristics coupled with means for air dilution.

Heretofore, various types of filters have been devised for use in cigarettes in order to screen out various filterable materials in the smoke generated during smoking. For example, filters made up of fibrous materials, such as a cellulose acetate, have been known for filtering out particulate matter from the smoke generated during smoking. However, such a filtering medium between a smoker's mouth and the tobacco column of the cigarette generally required additional drawing or inhaling forces on the part of the smoker in order to draw the smoke through the filtering material. As a result, a practical limit has been imposed on the amount of particulate matter that can be filtered out by a particular filtering material due to the need to have a pressure drop across a filter that can be tolerated by a smoker without discomfort.

In more recent times, attempts have been made to dilute the smoke stream from a cigarette with ventilating air to reduce the quantity of particulate matter drawn into a smoker's mouth for each puff while allowing the taste to pass through as taught in U.S. Pat. No. 3,242,925. Some of these attempts have used bypass arrangements by which a greater or lesser proportion of the cigarette smoke can be bypassed around a filter medium and drawn into a smoker's mouth. In some cases, the filters have been provided with passageways through which a portion of unfiltered smoke can be passed directly to the smoker's mouth. Such passageways have usually been provided directly in the filter material and the filter material has been constructed so as to be collapsed manually about the passageway to constrict the size of the passageway and, thus, reduce the proportion of unfiltered smoke passing through to a smoker, for example, as described in U.S. Pat. No. 3,270,750.

One of the reasons for utilizing filters with smoke passages was to provide a passageway through which a stream of concentrated, unfiltered smoke could pass. The impingement of this concentrated smoke stream on the smoker's tongue and taste buds was believed to impart a greater taste to the smoke, thereby lowering the amount of smoke required to be delivered to the smoker's mouth to achieve a given taste level. Since a smaller proportion of smoke can be directed into the smoker's mouth a concomitant decrease in the amount of particulate matter is drawn into the smoker's mouth. A filter which makes good utilization of this principle is described in U.S. Pat. No. 3,860,011 to Norman, et. al. The Norman, et. al., filter makes use of a non-deformable rigid tube centered inside a cylindrical layer of filter material, such as cellulose acetate, to deliver a high velocity stream of undiluted and unfiltered smoke into a smoker's mouth. Though the amount of smoke delivered is reduced in quantity, the intensity of smoke has the effect of enhancing the taste of the cigarette to the smoker. Norman, et. al., use ventilation air drawn-in from the surrounding environment to complement the draw resistance of the smoke passage. However, it has now been found that the smoke stream, issuing from the tube of the Norman, et. al., filter, remain too coherent and concentrated, and impinges on only a small area of the tongue, and that the smoke drawn into the smoker's mouth is too hot during the last few puffs when the tube intake is fairly close to the burning cone. In addition, the tube is hard to center in the filter which is undesirable from an aesthetic viewpoint.

Accordingly, it is an object of the present invention to provide a filter having a centered smoke passage of minimal filtering capability within a filter mdia to accurately direct a concentrated stream of smoke into a smoker's mouth without any of the disadvantages of the Norman, et. al., filter.

It is another object of the present invention to accurately regulate the amount of smoke delivered to the smoker's mouth while simultaneously maximizing the taste characteristics thereof.

A further object of the present invention is to eliminate the need for additional extensive capital investment when a manufacturer decides to make cigarettes from the same tabacco blend having different smoke delivery capabilities by eliminating the need for additional equipment.

Briefly, the invention provides a filter for a cigarette which allows a portion of relatively unfiltered smoke to enter a smoker's mouth at a relatively high concentration while reducing the volumetric delivery of smoke with drawn-in air from the surrounding environment. The invention also provides a method and apparatus for making a continuous filter rod for making cigarette filters.

The filter of the present invention is used in combination with a cigarette tobacco section and is joined to the tobacco section by a cylinder or outer wrap of tipping paper. The filter is composed of two concentric cylindrical layers of compacted filter material and a cylinder of perforated or inherently porous plugwrap paper. The inner cylinder defines a smoke passage of constant cross-sectional area throughout having a draw resistance for controlling the amount of smoke delivered to the smoker's mouth for a given draw. The filter material which makes up the inner cylinder should be of a structure that allows it to have a minimal effect on the filtration of the delivered smoke stream but yet creates a sufficient turbulent smoke-flow pattern so as to lower the temperature and coherency of the smoke stream drawn into the smoker's mouth. An outer layer of filter material surrounds and is concentric to the inner cylinder of filter material. The plugwrap paper is porous, e.g., the paper is either inherently porous or has numerous perforations some of which are aligned with perforations in the tipping paper. In either case, the number and size of the perforations in the tipping paper define the air flow path through the tipping paper and the layers of filter material to a smoker's mouth. The flow path is of a draw resistance to complement the draw resistance of the smoke passage whereby for a given draw a desired amount of smoke and ventilation air are drawn into the smoker's mouth.

Accordingly, the filter of the present invention delivers through a low resistance filter core to the smoker's mouth a concentrated smoke stream which is balanced off with additional air from the outside to yield a smoke stream containing low smoke solids and a high taste value in each puff delivered to the smoker's mouth.

The filter materials used to make the respective concentric cylindrical layers of the filter can be made of any suitable filter material provided that the inner cylinder has a lower resistance to the passage of smoke than the outer cylinder. Preferably, the filter materials are of cellulosic origin and most peferably both smoke filter cylinders are made of cellulose acetate.

The method of the invention includes the steps of generating a first stream of fibrous filter material and a second stream of fibrous filter material, of placing these streams in juxtaposition during travel at a first station while simultaneously enveloping the first stream of fibrous filter material circumferentially about the second stream of fibrous filter material, and of circumferentially enveloping a stream of paper about the juxtaposed streams of fibrous filter material during their continued travel to form a filter rod. During movement of the various continuous streams of materials, the first stream of fibrous filter material is constricted about the second stream to frictionally engage the second stream so that the second stream is positively gripped for continued travel with the fibrous material. An embodiment of this method involves subjecting the second stream of fibrous filter material to a longitudinal tension greater than the first stream of fibrous filter material during the rod making process.

The apparatus of this invention includes means for supplying a first and second continuous streams of fibrous filter material, a means for maintaining the second supplied stream of fibrous filter material under a longitudinal tension greater than the first supplied stream, a mandrel having a passageway for receiving and passage of the second supplied stream of fibrous filter material, a forming means for receiving the supplied streams of filter material and a stream of paper, said forming means circumferentially envelopes said mandrel to direct the first supplied stream of fibrous filter material and the paper circumferentially about the mandrel and the second supplied stream of filter material to form a filter rod. The mandrel is adjustable relative to the forming means to accurately position the second stream of filter material at the center of the first stream.

These and other objects and advantages of the invention will become more apparent from the following detailed description and appended claims taken in conjunction with the accompnaying drawings in which:

FIG. 1 illustrates a schematic view of an apparatus for making a filter rod according to this invention;

FIGS. 2 through 6 illustrate enlarged cross-sectional views of the apparatus at various stages, views 2 through 6, of filter formation;

FIG. 7 illustrates a part cross-sectional view of a cigarette having a filter made in accordance with this invention;

FIG. 8 illustrates a cross-sectional view of the filter in FIG. 7; and

FIG. 9 illustrates an enlarged view of part of the forming section of the apparatus of FIG. 1.

Figure 2:
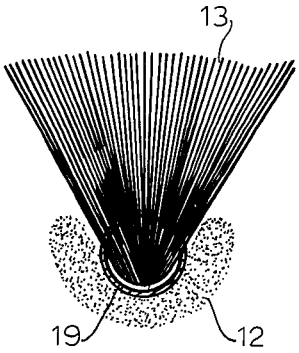
Figure 3:
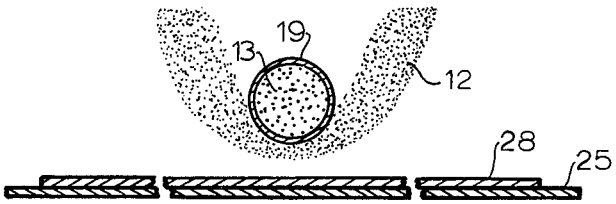
Figure 4:
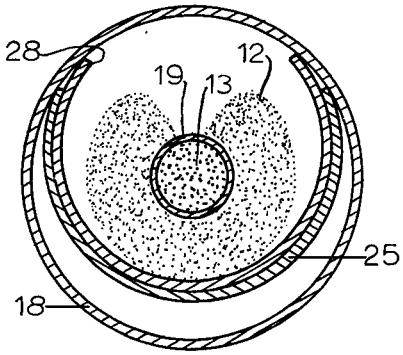

Referring to FIG. 1, the apparatus 10 for making the filter rod 11 of the present invention includes conventional means, not shown, for supplying two streams of fibrous filter material 12 and 13, such as cellulose acetate tow. In addition, the apparatus 10 includes means 14 and 15 for adjusting the tension applied on each of the streams 12 and 13 of filter material. A guide means 16, for example a funnel or trumpet shaped member, for positioning in a predetermined path the first stream 12 of tow for delivery to and in axial alignment below a guide-shaping means 17, to which has been delivered the secon stream 13 of filter material, and a rod former 18 of conventional construction for wrapping the first stream 12 of filter material about the second stream 13 of filter material and wrapping the two formed concentric cylinders into a filter rod 11.

Referring to FIGS. 1 and 9, the guide-shaping means 17, which receives the inner stream 13 of filter material, is positioned downstream of guide means 16, which positions the first stream 12 of filter material with respect to the guide-shaping means 17. Guide-shaping means 17 includes a hollow mandrel 19 of elongated, tapered length which passes through positioning means 20 and into the rod maker 18. The entrance end 21 (FIG. 2) of the guide-shaping means 17 is sized to receive the stream of filter material 13 with the material in a spread and decrimped manner. The diameter of the exit end 22 of mandrel 19 can vary depending upon the amount of fibrous material supplied and the desired bulk density of this material in the final rod 11, but is usually smaller than the entrance end 21.

As illustrated in FIG. 2, guide-shaping means 17 is positioned so that its base is parallel and contiguous to the flattened U-shaped stream 12 of fibrous material supplied from guide means 16. Furthermore, the guide-shaping means 17 is adjustable relative to the forming means (not shown) of the rod maker 18. For instance the guide-shaping means 17 can be mounted in a cantilever manner (not shown) on a support for adjusting the mandrel 19 vertically or horizontally, as described at column 3, lines 17 through 23 inclusive of U.S. Pat. No. 3,860,011 the disclosure of which is incorporated herein by reference.

The rod former 18 is of conventional construction and contains a forming block 22 and a tongue 23 mounted on the topside of the block 22. The block 2 and tongue 23 form a passageway (not shown) into which the mandrel 19 projects. This latter passageway is sized to receive the two streams 12 and 13 of filter material and is tapered internally to form an inwardly tapering surface for the passageway so that the passage way gradually diminishes in cross-section. In addition, the rod former 18 includes a conveyor 24 having a conveyor belt 25, such as a continuous fabric belt, which is driven by a belt drive wheel 26 over guide rolls 27 through the passageway formed by the blick 22 and tongue 23. The belt 25 is used to move a stream of porous web 28, e.g. plugwrap paper, from a suitable supply reel 29 into the passageway via guide rollers 30 as well as to convey the two streams 12 and 13 of filter material. The web 28 has a uniform pattern of perforations 31 (FIG. 7) throughout, or is inherently porous for purposes explained below.

As shown in FIG. 1, the rod former 18 includes a pair of folding sections 32 as are known, a glue or adhesive applicator 33 and a sealer 34. The folding sections 32 serve to fold the edges of the delivered web 28 towards each other in enveloping relationship to the two concentric cylinders of filter material 35 and 36 (FIG. 8) which are in a contiguous relationship at this point. The adhesive application 33 serves to apply a line of adhesive on the top surface of one edge so that the undersurface of the opposite edge can be sealed thereto by the subsequent folding section 32 and the sealer 34 to form the filter rod 11. The web 28 may also be of the type which has a heat activated resin preapplied to the surface, in which case, the applicator 33 may be eliminated.

A suitable cutting mechanism utilizing a knife 37 is disposed downstream of the sealer 34, as is known, for cutting the filter rod 11 into predetermined lengths 38. Each length may thereafter be cut into a multiplicity of filters.

Referring to FIG. 1, in operation, two separate streams of filter material 12 and 13 are fed from their respective supply sources, spread out and decrimped in a conventional fashion as is known, passed through a plasticizer chamber 39 and delivered into their respective guide means 16 and 17. The two streams of filter material 12 and 13 are pulled by conveyor belt 25 and a predetermined speed. As the first stream of filter material 12 passes through guide means 16, it is spread into a flattened U-shape (FIG. 2) and positioned so as to be in a parallel and contiguous relationship with the guide-shaping means 17 as it passes through guide means 20 into the rod maker 18. As filter stream 12 passes into the rod maker 18 between the folding block 22 and the tongue 23 the fibrous material is gradually reduced circumferentially due to a tapering of the tongue 23 relative to the forming block 22, thereby causing the filter material 12 to circumferentially envelop mandrel 19 to which has been supplied the second stream of filter material 13 which is in a compressed state due to the tapering of mandrel 19. As the filter material 12, which is now in the shape of a hollow cylinder, passes over the exit 21 of mandrel 19, it is brought into frictional contact with the filter material 13 which passes out of mandrel 19 within the rod former 18 whereby the first stream of filter material 12 is juxtaposed in enveloping, contiguous, circumferential relationship with the second stream of filter material 13. At the same time, the web of paper 28 is guided into the rod former 18 underneath the stream of filter material 12 and is folded into a general U-shape. Continued travel of the streams 12 and 13 of filter material causes filter stream 12 to be further constricted circumferentially about filter stream 13 to grasp or to frictionally engage filter stream 13 under a force sufficient to continuously pull the remaining portion of filter stream 13 from its supply source.

The movement of the fibrous material streams 12 and 13 is facilitated by the conveyor belt 25 and the paper web 28 as is known. In addition, the paper web 28 is subsequently folded about the constricted concentric, cylindrical layers 12 and 13 with the paper edges sealed together to form a filter rod 11 of continuous length. The filter rod 11 is then severed into predetermined lengths 38 by the knife 37.

The streams of filter material 12 and 13 may be fed from their respective supply sources at a rate approximately equal to the rate of consumption, with allowances being made for the blooming and decrimping of the filter material in accordance with conventional practices. The rate of consumption is governed by the speed of drive wheel 26 which may be driven by any conventional means.

Figure 5:
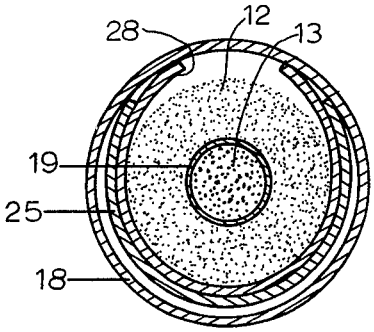
Figure 6:
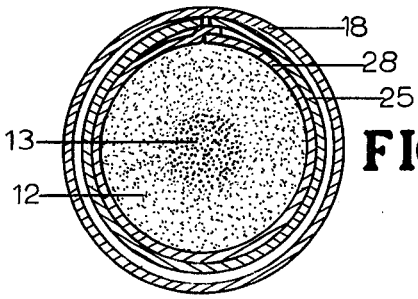

FIGS. 3 through 6 illustrate the respective positions of the two streams of filter material 12 and 13, the plugwrap paper 28 and the conveyor drive belt 25 just prior to entry into the rod maker 18 and at various stages inside the rod maker 18. FIG. 5 illustrates the relationship between the positions of the streams of filter material 12 and 13 just prior to passage of filter stream 13 from the inside of mandrel 19. At this point, the stream of filter material 12 has completely enveloped mandrel 19 and due to the circumferentially constrictive force applied by the inner surface of the rod maker 18, the stream of filter material 12 will frictionally engage stream of filter material 13 upon its exit from mandrel 19.

In one embodiment of the present invention filter material stream 13 is placed under a linear tension greater than that of filter stream 12 during the rod forming process. This can be accomplished by running the pair of frictional rollers 15 at a linear surface speed below that of conveyor drive wheel 26. This results in a lower pressure drop and higher flavor yield for the inner cylinder 35 (FIG. 8) of filter material. At the same time, the filter material stream 12 is delivered to the rod maker 18 at a linear surface speed higher than that of the conveyor drive wheel 26. This can be accomplished by regulating the speed of the pair of friction rollers 14. This results in a packing of the filter material in the outer concentric cylinder 36 (FIG. 8), thereby giving it a higher pressure drop and a greater filtering ability than the inner filter cylinder 35. Subjecting the inner tow to a greater tension than the outer layer of tow 12 permits the attainment of a greater bulk density of filter material inside the inner cylinder of filter material 35, thereby giving the smoke passageway 35 greater structural strength so that it remains substantially non-deformable during smoking. The use of a cellulose acetate tow that still retains some degree of registration for the inner tow 35 of the filter has proven to be of particular effectiveness, as discussed below, when used in this embodiment of the invention.

Referring to FIGS. 7 and 8, a filter 39 formed from the filter rod 11 includes an inner cylindrical core of coarse fibrous filter material 35 surrounded by an annular layer of compacted filter material 36, a wrapping of perforated plugwrap paper 40 and an outer wrap of tipping paper 41. The filter 39 is mounted, as is known, by means of the outer wrap of tipping paper 41 on a tobacco column 42 to form a cigarette. The outer wrap of tipping or mouthpiece paper 41 is provided with a circumferential row of perforations 43 which are located at about the mid-section of the filter 39. The number of individual perforations 43 or the number of rows thereof will vary with the amount of ventilating air desired to be drawn in with each puff of the cigarette.

As shown in FIG. 8, the inner cylindrical core of filter material 35 is centered on the axis of the filter 39 and forms a passageway through which substantially all of the smoke will pass into the smoker's mouth.

Referring to FIG. 7, as the smoker takes a puff of his normal puff volume, the flow of smoke through the cigarette into and through the two annular concentric layers of filter material 35 and 36 and the air flow through the perforations 43 in the tipping paper 41 will be proportional to the draw resistances of the two annular layers of filter material 35 and 36. Inasmuch as the draw resistance of the outer annular layer of filter material 36 is relatively high, there is virtually no delivery of smoke between the tobacco column 42 and the smoker's mouth through the outer annular layer 36.

The smoke generated in the burning cigarette cone during the puffing process predominantly passes through the inner annular layer of filter material 35 due to its lower pressure drop. This smoke reaches the smoker's mouth in a relatively concentrated state and at a relatively high velocity. Even though the quantity of this smoke is reduced when compared to normal filter cigarettes, its relatively unfiltered state, high concentration and high impingement velocity have the effect of enhancing the taste of the cigarette to the smoker.

That portion of smoke generated in the cigarette cone which passes into the outer annular layer of filter material 36 from the tobacco column 42 passes back into the inner layer of filter material 35 before entering the smoker's mouth thereby achieving complete radial flow across the fibers for the smoke entering this outer annular layer. This is due to the combined effect of the lower pressure drop of the inner layer of filter material 35 and the laminar flow of ventilation air drawn in from the surrounding environment through perforations 43. This laminar flow of ventilation air tends to compress and form an annular ring around the smoke stream within the inner layer of filter material 35. Surprisingly, only a small amount of actual mixing of the smoke stream with the ventilation air occurs before entering the smoker's mouth.

In addition to the smoke generated in the cigarette cone, the smoker's puff will contain, as indicated above, air drawn in from the surrounding environment via the perforations 43 in the tipping paper, through the plugwrap paper 40 and the filter materials 35 and 36 into the smoker's mouth. Only a relatively small proportion of the air mingles with the smoke before it is delivered into the smoker's mouth. This enhances the possibility of the smoker getting an increased flavor impression from the delivered smoke stream, whereas in conventional cigarettes utilizing perforated tipping, diluting air and smoke mix within the filter resulting in the delivered smoke stream being subsantially prediluted before impinging in the smoker's mouth. The air drawn through the perforations 43 appears to form a laminar sheath within the peripheral layer of filter material and the outer extremities of the inner layer of filter material and essentially confines or compresses the smoke path to the central core element. Experimental and mathematical models have confirmed this effect. Initial smoke deposition occurs on the whole surface of the tobacco end of the filter, but from the perforations on downstream, the deposition occurs substantially only on the inner cylindrical coarse layer of filter material.

The amount of air drawn in from the surrounding environment can be varied by the number of individual perforations in the tipping paper and the porosity of the plugwrap paper. A suitable amount of air to be drawn in from the outside, measured as percent dilution through substantially no dilution of the smoke stream occurs, is from about 15 percent to about 60 percent, perferably from about 25 percent to about 55 percent, and most preferably from about 35 percent to about 45 percent, of the total volume of the puff delivered to the smoker's mouth.

The amount and velocity of the smoke stream and of the air stream can be regulated by varying the respective draw resistances of the two annular layers of filter material and the number of perforations. The smoke yield of the cigarette can be varied over a wide range by a choice of proper combinations of these variables.

The filter materials suitable for use in the manufacture of the filter of the present invention can be any conventional filter material provided the inner layer is of such a construction so as to have a lower pressure drop than the outer annular layer. Preferably both layers are made from cellulose acetate tows. The cellulose acetate tow used in the manufacture of the inner layer of filter material should be coarse enough to offer only minimal draw resistance, have relatively little effective filtration efficiency and should be able to diffuse the smoke stream issuing from the filter to only a moderate degree. This would result in an increase in the impingement area on the tongue so as to remove the objection of too concentrated a smoke stream, as in the filter of U.S. Pat. No. 3,860,011, but not increase the area of impingement on the tongue to the extent that you would destroy the essential feature of the filter, e.g. still yield a much more concentrated smoke stream than issues from a normal cigarette filter. Illustrative of the cellulose acetate tows which are suitable for the inner cylinder of filter material in this invention are those having denier per filament values (dpf) of 6 or higher with concomitant total denier bundle values of from about 10,000 to about 50,000 total denier. Preferably the cellulose acetate tow used in the inner layer of filter material has a dpf value of from about 7 to about 9 with concomitant total denier values of less than about 25,00 being limited on the lower end of total denier values by the capabilities of tow manufacturers. The cellulose acetate tow used for the outer annular layer of filter material in this invention should offer more draw resistance than the tow selected for the inner layer. Illustrative of cellulose acetate tows which are suitable for use in this outer layer of filter material are those of from about 1 dpf to about 5 dpf and 10,000 to 50,000 total denier values. Preferably the outer tow is one having from about 2 to about 4 dpf value with a concomitant total denier value of from about 35,000 to about 45,000. The inner tow should have a dpf value of from about 1.5 to 5 times the dpf value for the outer tow, preferably from about 2 to about 4 times as great as the outer tow's dpf value. These ratios should hold true for the majority of the tows provided their total denier values fall in the range of from about 10,000 to 50,000.

A filter whose outer annular layer of filter tow has been substantially deregistered as opposed to the inner layer of filter material has proven to be of particular utility in the present invention. Filters of this type may be prepared by the use of a cellulose acetate tow that still retains some degree of registration, from about 5 percent to about 30 percent, preferably from about 10 to 25 percent, registration for the inner layer of filter tow and a substantially deregistered tow for the outer annular layer. The degree of registration of the respective tow layers may be regulated by varying the extent of blooming and decrimping of the tows and the amount of tension placed thereon during the rod making process.

Referring to FIGS. 7 and 8, the inner layer of filter material 35 may assume any geometric shape but preferably is substantially cylindrical in shape and of substantially uniform cross-section throughout. The diameter of the inner layer of filter material 35 preferably is no more than one half of the diameter of the filter, e.g., the cross-sectional area is preferably less than about 25 percent of the total cross-sectional area of the filter. A diameter of from about 1 millimeter (mm) to about 5 mm, preferably from about 3 mm to 4 mm, for the inner layer of filter material 35 is suitable in the practice of the present invention.

The apparatus and method have been successfully to make 126 mm long, 24.6 mm circumference filter rods on production machinery at a production rate of about 500–600 cigarettes per minute using 2.8 dpf/38,000 total denier cellulose acetate tow for the outer annular layer of filter material and 8.0 dpf/20,000 total denier cellulose acetate tow for the inner layer of filter material.

The same production rate above was achieved using the following cellulose acetate tows for the outer annular layer of filter material while using the 8.0 dpf/20,000 total denier tow for the inner layer.

| SAMPLE | INNER TOW | OUTER TOW |
|---|---|---|
| A | 8.0 dpf/20,000 total denier | 1.8 dpf/38,000 total denier |
| B | 8.0 dpf/20,000 total denier | 3.3 dpf/40,000 total denier |
| C | 8.0 dpf/20,000 total denier | 5.0 dpf/30,000 total denier |

Using the above filter rods, four 85 mm (21 mm filter section) sample cigarettes were fabricated and submitted to standard analytical smoking tests. The data listed in Table I below are typical of results that can be obtained with the filter of this invention. The yield reductions are calculated on the basis of the same tobacco column smoked without a filter.

TABLE I

| | Sample | | | |
|---|---|---|---|---|
| | 1 | 2 | 3 | 4 |
| Outer Tow (dpf/total denier) | 1.8/38 | 2.8/38 | 3.3/40 | 5.0/30 |
| Inner Tow | 8.0/20 | 8.0/20 | 8.0/20 | 8.0/20 |
| Pressure Drop of Filter (cm H O) | 9.9 | 7.8 | 7.7 | 4.4 |
| Diluting Air (%) | 43.2 | 44 | 36 | ND** |
| Yield, Milligram per cigarette | | | | |
| NFDS* | 10.1 | 10.9 (11.0)*** | 11.3 | 12.7 |
| Nicotine | 0.80 | 0.83 (0.74)*** | 0.77 | 0.92 |
| Yield Reduction (%) Per Cigarette | | | | |
| NFDS | 65.7 | 63.1 (62.7) | 61.7 | 57.0 |
| Nicotine | 51.5 | 49.7 (55.1) | 53.3 | 44.2 |

*NFDS - Nicotine free dry solids.
**Not determined.
***Duplicate.

Using calculations based on the nicotine generated in the smoke stream of a non-filtered tobacco column, a filtered tobacco column without perforations and a filtered tobacco column with perforations it was found that the perforations in the filter caused a yield reduction in the amount of nicotine of 9.1%. The cigarettes used in this experiment were the same as those of sample 2 in Table I.

Experiments have shown that the use of the filter of the present invention on cigarettes allows the use of the cellulose acetate tows for the inner smoke passage having effective filtration efficiencies which closely approximates that of present commercial high taste and high smoke solids (nicotine + NFDS) cigarettes (about 40%), and still deliver a high tast low total solids smoke stream to the smoker. An inner smoke passage of minimal filtration efficiency and low draw resistance, without the concomitant deficiencies of the Norman, et. al., filter discussed above, is desirable.

The cigarettes were prepared using a conventional citrated web having a Griner porosity of 20 seconds. The inner tow, 8.0 dpf/20,000 total denier, used in the manufacture of the above cigarette filters was only approximately 80% deregistered. In the manufacture of the above cigarette filters, the inner tow's 13 linear surface speed was 80% that of the conveyor belt 25, the linear surface speed of which was only 80% that of outer tow 12, thereby causing a degree of packing higher than normal of the outer tow 12 and subjecting the inner tow to a tension along its longitudinal axis which is greater than normal and greater than outer tow 12. In working with tows which are not substantially deregistered a suitable tension may be created by running the linear surface speed of the tow, in this particular apparatus the rollers 15, from about 75 to about 95 percent that of the rod making apparatus, which in this particular case would be the linear surface speed of conveyor belt 25. In order to achieve the proper amount of packing of filter material 12 in the outer annular layer of filter rod 11, the outer tow may be fed at a speed of from about 5 percent to about 25 percent of the linear surface speed of the rod making machine, conveyor belt 25.

What is claimed is:

1. A tobacco filter cigarette comprising a tobacco column, a filter mouthpiece and a cylinder of tipping paper joining said filter mouthpiece to said tobacco column, said filter mouthpiece consisting of a first cylindrical passageway comprised of a coarse cellulose acetate fibrous tow having a dpf value from about 7 to about 9 and a total denier value from about 15,000 to about 25,000, said first passageway having a cross-sectional area that is no more than 25 percent of the total cross-sectional area of said filter, a second passageway comprised of a compacted cellulose acetate fibrous tow having a dpf value from about 1 to about 5 and a total denier value of from about 10,000 to about 50,000, said second passageway circumferentially enveloping said first passageway, and said dpf value for the tow of said first passageway being from about 1.5 to 5 times the dpf value for the tow of said second passageway, and a cylinder of air pervious plugwrap paper receiving and defining said second passageway, said tipping paper having a plurality of perforations communicating the surrounding air with said second passageway defining an air flow path having a draw resistance to complement said draw resistance of said first passageway whereby for a givendraw ventilation air, in an amount of from about 15 percent to about 60 percent of the total delivered puff volume, and relatively unfiltered smoke eneters the smoker's mouth.

2. The combination set forth in claim 1 wherein the compacted cellulose acetate tow has a value of from about 2 to about 4 dpf and a value of from about 35,000 to 45,000 total denier.

3. The combination set forth in claim 1 wherein the fibers of the second passageway are substantially deregistered as opposed to the fibers of the first passageway.

4. The combination set forth in claim 3 wherein the fibers of the first passageway retain from about 5 to about 25 percent of their original registration.

* * * * *

UNITED STATES PATENT AND TRADEMARK OFFICE

CERTIFICATE OF CORRECTION

PATENT NO. : 4,034,765

DATED : July 12, 1977

INVENTOR(S) : Floyd Van Hall

It is certified that error appears in the above-identified patent and that said Letters Patent are hereby corrected as shown below:

At the end of line 36 of column 4 the number "2" should read -- 22 --.

Signed and Sealed this

*Twenty-eighth* Day of *March 1978*

[SEAL]

*Attest:*

RUTH C. MASON
*Attesting Officer*

LUTRELLE F. PARKER
*Acting Commissioner of Patents and Trademarks*